US009134650B2

(12) United States Patent
Saito et al.

(10) Patent No.: US 9,134,650 B2
(45) Date of Patent: Sep. 15, 2015

(54) DEVELOPING DEVICE AND IMAGE FORMING APPARATUS

(71) Applicant: Konica Minolta, Inc., Chiyoda-ku, Tokyo (JP)

(72) Inventors: Kazuhiro Saito, Tokyo (JP); Tomohiro Kawasaki, Kanagawa (JP); Kazuteru Ishizuka, Saitama (JP); Tatsuya Furuta, Tokyo (JP); Seiko Itagaki, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/104,557

(22) Filed: Dec. 12, 2013

(65) Prior Publication Data

US 2014/0161472 A1 Jun. 12, 2014

(30) Foreign Application Priority Data

Dec. 12, 2012 (JP) ..... 2012-271297

(51) Int. Cl.

*G03G 15/08* (2006.01)
*G03G 15/09* (2006.01)
*G03G 15/00* (2006.01)

(52) U.S. Cl.

CPC ..... *G03G 15/0824* (2013.01); *G03G 15/0849* (2013.01); *G03G 15/0856* (2013.01); *G03G 15/5058* (2013.01); *G03G 2215/0132* (2013.01); *G03G 2215/0164* (2013.01)

(58) Field of Classification Search

CPC ..... G03G 15/0824; G03G 15/0829; G03G 15/0849; G03G 2215/0888
USPC ..... 399/27, 30, 58, 62, 63, 259
See application file for complete search history.

(56) References Cited

U.S. PATENT DOCUMENTS

| | | | | |
|---|---|---|---|---|
| 7,346,286 | B2 * | 3/2008 | Matsumoto et al. | 399/259 X |
| 8,515,296 | B2 * | 8/2013 | Takahashi | 399/30 |
| 2009/0129792 | A1 * | 5/2009 | Izumi et al. | 399/27 |
| 2011/0052222 | A1 * | 3/2011 | Furuta et al. | 399/27 |

FOREIGN PATENT DOCUMENTS

| | | | |
|---|---|---|---|
| JP | 02021591 | B2 | 5/1990 |
| JP | 2986001 | B2 | 10/1999 |
| JP | 2001154543 | A | 6/2001 |
| JP | 2001183893 | A | 7/2001 |
| JP | 2011053394 | A | 3/2011 |

OTHER PUBLICATIONS

Japanese Notice of Reasons for Rejection corresponding to Patent Application Number: 2012-271297; Dispatch Date: Feb. 3, 2015, with English translation.

* cited by examiner

*Primary Examiner* — Sophia S Chen
(74) *Attorney, Agent, or Firm* — Cantor Colburn LLP

(57) ABSTRACT

Disclosed herein is a developing device including: a developer housing section configured to house a developer including toner and carrier; a carrier replenishing section configured to supply the carrier to the developer housing section; a carrier concentration detecting section provided at a position near a carrier replenishment position at which the carrier is received from the carrier replenishing section in the developer housing section, the carrier concentration detecting section being configured to detect a carrier concentration in the developer housing section; and a carrier replenishment determination section configured to determine whether the carrier is properly supplied to the developer housing section on the basis of a result of detecting by the carrier concentration detecting section.

7 Claims, 9 Drawing Sheets

DEVELOPING DEVICE AND IMAGE FORMING APPARATUS

CROSS REFERENCE TO RELATED APPLICATIONS

This application is entitled and claims the benefit of Japanese Patent Application No. 2012-271297, filed on Dec. 12, 2012, the disclosure of which including the specification, drawings and abstract is incorporated herein by reference in its entirety.

BACKGROUND OF THE INVENTION

1. Field of the Invention

The present invention relates to a developing device and an image forming apparatus.

2. Description of Related Art

Conventionally, one-component development methods and two-component development methods are employed in electrophotographic developing devices. In one-component development methods, toner makes contact with each member of a developing device at a part for supplying toner, a part for charging toner, a part for neutralizing toner, and a part for collecting toner, and as a result stress is applied to the toner. Thermoplastic resins are used to form a toner, and inorganic fine particles serving as a flowability modifier are attached on the surface of the toner. Therefore, due to the above-mentioned stress, thermal variation may be caused and the inorganic fine particles may be buried in the toner surface. In the case of high-speed apparatuses, the stress applied to toner is even greater since the rotational speed of each component thereof is high. For this reason, the speed is limited. In addition, in recent years, the particle size of toner is remarkably reduced as the image quality is enhanced, and a toner having the diameter of 6 [μm] or less is not uncommon. Since such a small-sized toner is treated with many post-treatment materials and its fluidity is degraded, the aggregation of the toner and burying of the post-treatment materials due to the above-mentioned stress frequently occur. In addition, there has been a growing trend toward low-temperature fixation in view of environmental considerations. This trend results in decreased thermotolerance, which is disadvantageous in terms of the above-mentioned stress.

In two-component development methods, toner charged by triboelectric charging of the toner and carrier is attached to an electrostatic latent image formed on an image bearing member to thereby develop the image. In a developing device, the ratio of the toner and carrier is kept at a certain ratio to maintain the charging state of the toner. However, when a toner image is developed on the electrostatic latent image formed on the image bearing member, the toner becomes insufficient. Therefore, toner is supplied by replenishing means. The toner supplied by the replenishing means is uncharged toner, which is charged when it is stirred with a developer in a developing device by stirring means in the developing device, and conveyed by conveying means in the developing device. Since in such a method charging is performed by mixing particles, the stress applied to toner is small. Accordingly, in comparison with the case of one-component development methods, the toner has a longer life, and besides, has greater adaptability to high speed. Since the surface area of the carrier is greater than that of the toner, the carrier is less likely to be contaminated by the toner adhered to the surface of the carrier. However, after a long period of use, contamination (spent) on the surface of the carrier increases, and thus the performance for charging toner decreases with time. As a result, problems such as fogging and toner scattering occur. In order to extend the life of two-component developing devices, it is conceivable to increase the amount of carrier housed in the developing device. In that case, however, the size of the developing device is increased, which is undesirable.

To solve the above-mentioned problems of two-component developers, Japanese Examined Patent Publication No. 2-21591 discloses a developing device of a trickle type in which a developer is supplied to the developing device little by little, and a developer whose charging performance is degraded is discharged from the developing device little by little, to thereby suppress the increase of degraded carrier. This developing device utilizes change in volume of the developer to discharge the excess and degraded developer so as to maintain a substantially constant volume level of the developer in the developing device. With this developing device of the trickle type, the degraded carrier in the developing device is replaced by newly supplied carrier, and the charging performance of the carrier in the developing device can be maintained at a substantially constant level.

A device of a trickle type has been conceived in which, for the purpose of simplifying the configuration of the device, toner and carrier are supplied from a developer cartridge that houses a developer obtained by mixing the toner and carrier at a constant ratio so as to simultaneously supply the toner and carrier. However, a toner consumption amount per one recording sheet (hereinafter referred to simply as "toner consumption amount") differs greatly depending on the image to be formed. For example, a document with only letters tends to consume a small amount of toner while a photographic image tends to consume a large amount of toner. On the other hand, degradation of carrier depends on the number of stirring carried out in the developing device, in other words, the number of image formation (the number of recording sheets), not on the toner consumption amount.

Therefore, when the developer obtained by mixing the toner and carrier at a constant ratio is supplied in accordance with the toner consumption amount, then a large amount of toner has to be supplied in the case where the toner consumption amount is large, and as a result, carrier is unnecessarily supplied and wastefully discarded. Conversely, in the case where the toner consumption amount is small, it is not necessary to supply a large amount of toner, and therefore, the amount of carrier to be supplied is decreased, and, so to speak, the metabolism of the carrier is deteriorated, which may degrade the charging performance. For this reason, techniques are proposed in which toner and carrier are not previously mixed, but are separately supplied (see, for example, Japanese Patent Application Laid-Open No. 2001-183893, and Japanese Patent No. 2986001).

In the technique according to Japanese Patent Application Laid-Open No. 2001-183893, a toner concentration detector that stably detects the toner concentration (the ratio of toner in the developer) in a steady state in a developing device is provided at a position where supplied toner and carrier are sufficiently mixed with a developer in the developing device. When the toner concentration detected by the toner concentration detector is lower than a previously set toner concentration, toner replenishment is performed for the toner consumed by the development. When the toner concentration detected by the toner concentration detector is not reset to a predetermined value, or is further decreased after the toner replenishment, a warning message is displayed on a monitor, for example. In this manner, a user can recognize that the toner replenishment has not been properly performed, and can recognize the necessity of measures such as reconditioning of a toner replenishment mechanism and replacement of a toner bottle that is provided above a toner hopper and configured to supply toner to the toner hopper.

On the other hand, when an error occurs in a carrier replenishment mechanism or when the carrier hopper is empty, the carrier replenishment is not properly performed. Since carrier in the developing device is not typically consumed, however, the toner concentration detected by the toner concentration detector does not change, and thus the user cannot recognize the fact that the carrier replenishment has not been properly performed. In an early stage, a carrier replenishment failure has no influence on formed images and raises no problem. However, since degraded carrier is not replaced with newly supplied carrier, degradation of carrier is gradually facilitated, and accordingly the toner charging performance is degraded with time. As a result, the problems such as fogging and toner scattering occur.

It is to be noted that, while Japanese Patent No. 2986001 discloses a technique in which the toner concentration in a developing device and the amount of discharged developer are detected, whether the carrier replenishment has been properly performed cannot be recognized since the developer to be discharged is strongly influenced by factors (such as inclination of the developing device and change in volume of the developer due to environmental changes) other than the carrier replenishment.

SUMMARY OF THE INVENTION

An object of the present invention is to provide a developing device and an image forming apparatus which can prevent problems which are caused when supply of carrier has not been properly performed in the case where toner and carrier are separately supplied.

To achieve the abovementioned object, a developing device reflecting one aspect of the present invention includes a developer housing section configured to house a developer including toner and carrier; a carrier replenishing section configured to supply the carrier to the developer housing section; a carrier concentration detecting section provided at a position near a carrier replenishment position at which the carrier is received from the carrier replenishing section in the developer housing section, the carrier concentration detecting section being configured to detect a carrier concentration in the developer housing section; and a carrier replenishment determination section configured to determine whether the carrier is properly supplied to the developer housing section on the basis of a result of detecting by the carrier concentration detecting section.

Desirably, in the above-mentioned developing device, the carrier concentration detecting section measures a magnetic permeability of the developer in the developer housing section to detect the carrier concentration.

Desirably, in the above-mentioned developing device, the carrier replenishment determination section determines that the carrier is properly supplied to the developer housing section when a carrier concentration detected by the carrier concentration detecting section is not lower than a predetermined concentration, and determines that the carrier is not properly supplied to the developer housing section when the carrier concentration detected by the carrier concentration detecting section is lower than the predetermined concentration.

Desirably, in the above-mentioned developing device, the carrier replenishment determination section determines whether the carrier is properly supplied to the developer housing section on the basis of a result of detecting by the carrier concentration detecting section in a period from a start of supply of the carrier by the carrier replenishing section until the carrier exits a detecting region of the carrier concentration detecting section.

Desirably, in the above-mentioned developing device, the carrier replenishment determination section determines whether the carrier is properly supplied to the developer housing section on the basis of a result of detecting by the carrier concentration detecting section in a period from a time when the carrier starts to pass through a detecting region of the carrier concentration detecting section until the carrier exits the detecting region, after supply of the carrier by the carrier replenishing section is started.

Desirably, the above-mentioned developing device further includes a notification section configured to indicate a result of determination by the carrier replenishment determination section when the carrier replenishment determination section determines that the carrier is not properly supplied to the developer housing section.

An image forming apparatus reflecting another aspect of the present invention includes the above-mentioned developing device.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, the present embodiment is described in detail with reference to the drawings.

[Configuration of Image Forming Apparatus 1]

Figure 1:
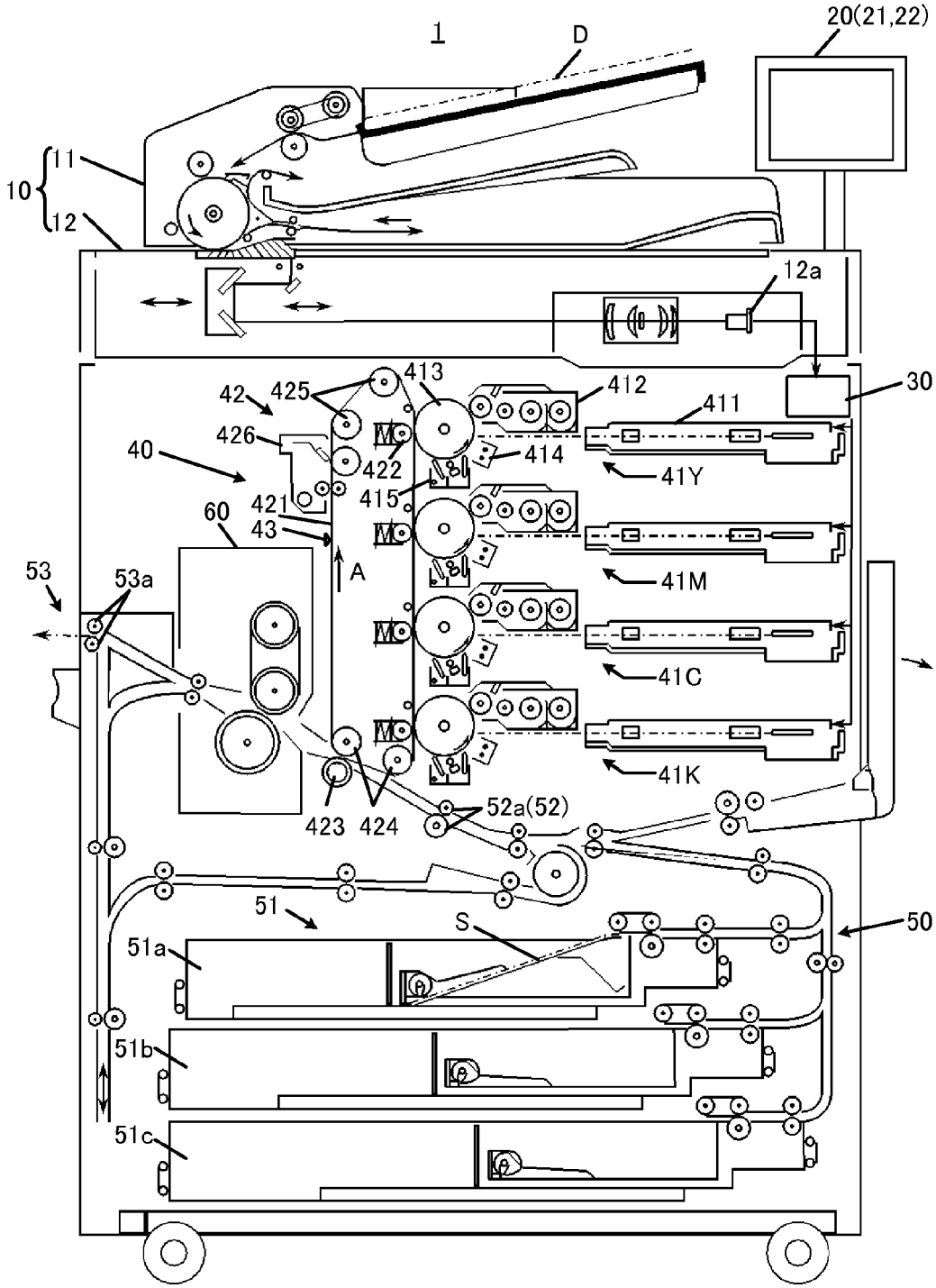
FIG. 1 is a vertical sectional view of an image forming apparatus according to the present embodiment.
Figure 2:
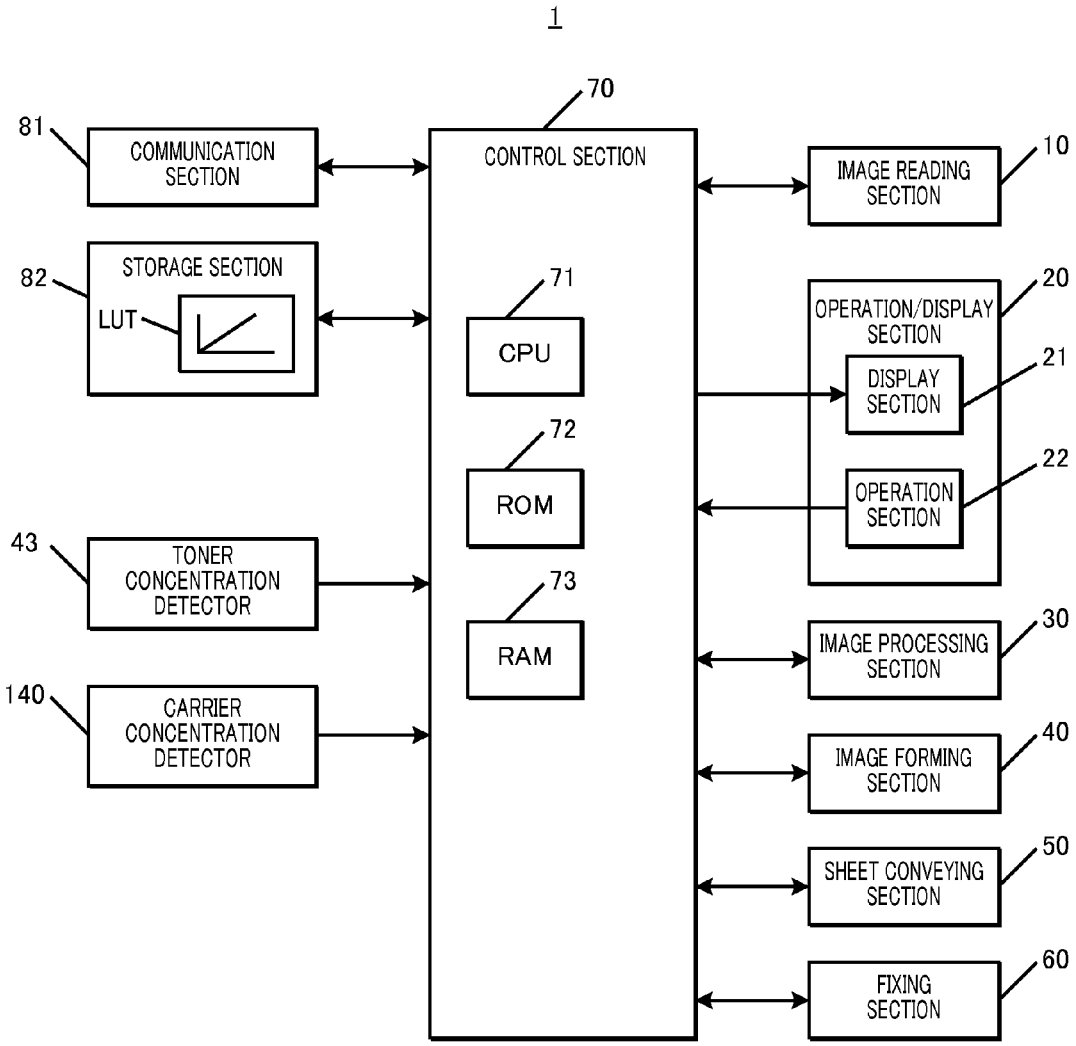
FIG. 2 is a control block diagram of the image forming apparatus according to the present embodiment.

Image forming apparatus 1 illustrated in FIGS. 1 and 2 is a color image forming apparatus with an intermediate transfer system using electrophotographic process technology. That is, image forming apparatus 1 transfers (primarily transfers) respective toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondarily transfers) the resultant image to sheet S, to thereby form an image.

A tandem system is adopted for image forming apparatus 1. In the tandem system, respective photoconductor drums 413 corresponding to the four colors of YMCK are placed in series in the miming direction of intermediate transfer belt 421, and the toner images of the four colors are sequentially transferred to intermediate transfer belt 421 in one cycle.

As illustrated in FIGS. 1 and 2, image forming apparatus 1 includes image reading section 10, operation/display section 20, image processing section 30, image forming section 40, sheet conveying section 50, fixing section 60, and control section 70. Control section 70 functions as a carrier replenishment determination section.

Control section 70 includes central processing unit (CPU) 71, read only memory (ROM) 72, and random access memory (RAM) 73. CPU 71 reads a program suited to processing details out of ROM 72, develops the program in RAM 73, and controls an operation of each block of image forming apparatus 1 in cooperation with the developed program. At this time, CPU 71 refers to various pieces of data stored in storage section 82. Storage section 82 is composed of, for example, a non-volatile semiconductor memory (so-called flash memory) or a hard disk drive.

Control section 70 transmits and receives various data to and from an external apparatus (for example, a personal computer) connected to a communication network such as a local area network (LAN) or a wide area network (WAN), through communication section 81. Control section 70 receives, for example, image data transmitted from the external apparatus, and performs control to form an image on a recording sheet on the basis of the image data (input image data). Communication section 81 is composed of, for example, a communication control card such as a LAN card.

Image reading section 10 includes auto document feeder (ADF) 11, document image scanner 12, and the like. Auto document feeder 11 causes a conveyance mechanism to feed document D placed on a document tray, and sends out document D to document image scanner 12. Auto document feeder 11 can successively read images of documents D placed on the document tray.

Document image scanner 12 optically scans a document fed from auto document feeder 11 to its contact glass or a document placed on its contact glass, and brings light reflected from the document into an image on the light receiving surface of charge coupled device (CCD) detector 12*a*, to thereby read the document image. Image reading section 10 generates input image data on the basis of reading results provided by document image scanner 12. Image processing section 30 performs predetermined image processing on the input image data.

Operation/display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 70. Display section 21 functions as a notification section.

Operation section 22 includes various operation keys such as a numeric keypad and a start key. Operation section 22 receives various inputting operations performed by a user, and outputs operation signals corresponding to the inputting operations to control section 70. It is to be noted that the operation signals may be output from external apparatuses to control section 70 via communication section 81.

Image processing section 30 includes a circuit that performs digital image processing suited to initial settings or user settings, on the input image data, and the like. In addition, image processing section 30 performs, on input image data, tone correction, various kinds of correction processes such as color correction, or a compression process, and the like. Image forming section 40 is controlled on the basis of image data subjected to such processes.

Image forming section 40 includes: image forming units 41Y, 41M, 41C, and 41K for images of color toners respectively containing a Y component, an M component, a C component, and a K component on the basis of the input image data; intermediate transfer unit 42; and toner concentration detector 43, and the like.

Image forming units 41Y, 41M, 41C, and 41K for the Y component, the M component, the C component, and the K component have the same configuration except for the color to be used. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Next, the configuration of image forming unit 41 will be described taking image forming unit 41Y as an example. Image forming unit 41Y includes exposing device 411, developing device 412, photoconductor drum 413 (image bearing member), charging device 414, cleaning device 415, and the like.

Photoconductor drum 413 is, for example, a negative charge type organic photoconductor (OPC) formed by sequentially stacking an under coat layer (UCL), a charge generation layer (CGL), a charge transport layer (CTL), and an over coat layer (OCL) on the circumferential surface of a conductive cylindrical body (elementary tube) made of aluminum. It is to be noted that photoconductor drum 413 may also be a photoconductor having a belt form, not a roller form.

Charging device 414 negatively charges the entire surface of photoconductor drum 413. Charging device 414 may be of any of a contacting roller charging type, and a non-contacting corona charging type.

Exposure device 411 is composed of, for example, a semiconductor laser, and irradiates photoconductor drum 413 with laser light corresponding to the image of the Y component. Because the positive charge is generated in the charge generation layer of photoconductor drum 413 and is transported to the surface of the charge transport layer, the surface charge (negative charge) of photoconductor drum 413 is neutralized. An electrostatic latent image of the Y component is formed on the surface of photoconductor drum 413 due to a difference in potential from its surroundings.

Figure 3:
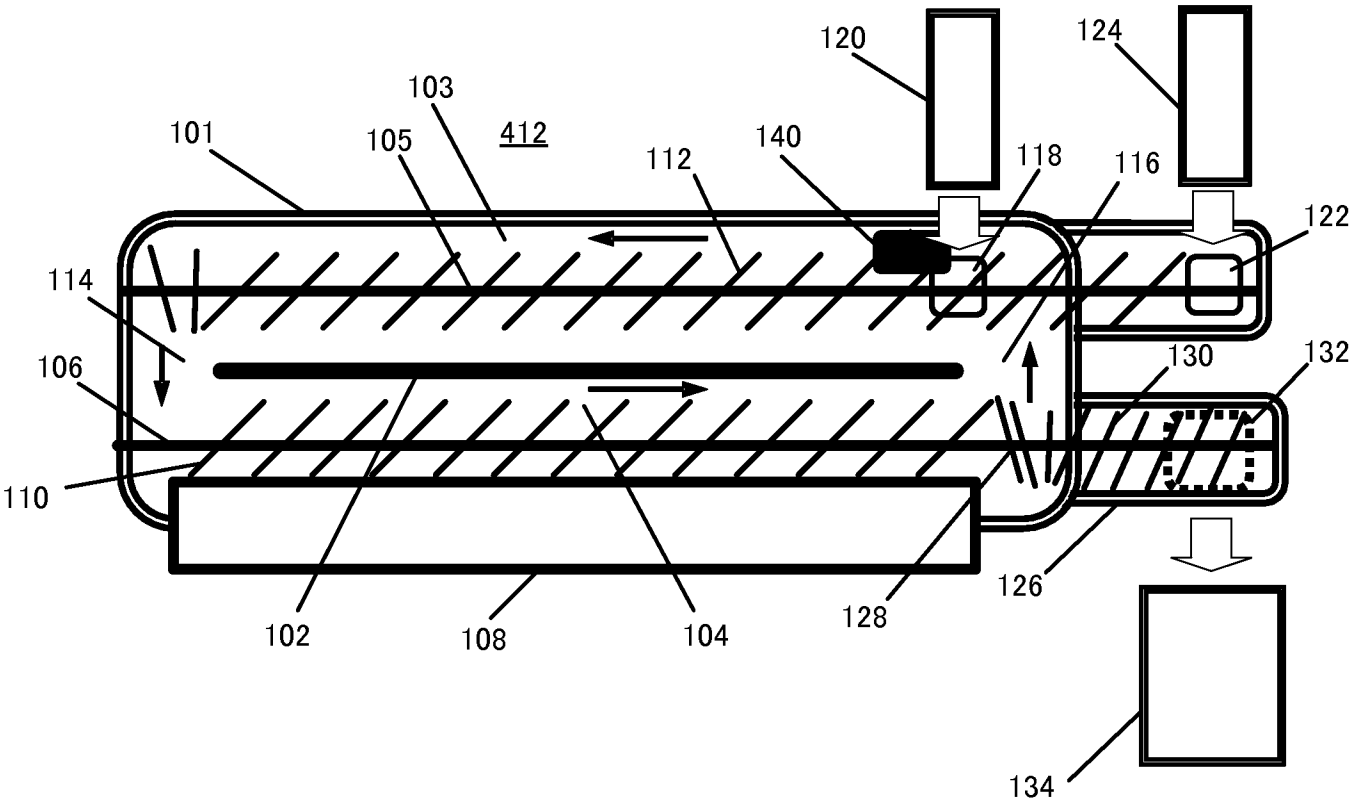
FIG. 3 illustrates a configuration of a developing device according to the present embodiment.

Developing device 412 houses a developer of the Y-component. The developer is a two-component developer composed of carrier and toner having small particle size. As illustrated in FIG. 3, developing device 412 drives developing roller 108 into rotation to attach the toner of the Y-component to the surface of photoconductor drum 413. Thus, developing device 412 visualizes the electrostatic latent image to form a toner image.

Toner particles used in developing device 412 are typically granulated by mixing, in a binder resin, a colorant, and as necessary, a charge control agent, a releasing agent and the like so as to have a predetermined particle size. Thereafter, the particles thus granulated are coated with an external additive so as to have a particle size of about 3 to 15 [μm]. For the granulation of toner particles, publicly known methods such as pulverization methods, emulsion polymerization methods, and suspension polymerization methods may be employed.

Drum cleaning device 415 includes a drum cleaning blade that is brought into sliding contact with the surface of photoconductor drum 413. Residual toner that remains on the surface of photoconductor drum 413 after the primary transfer is removed by the drum cleaning blade. It is to be noted that cleaning device 415 may be a cleaner of a multiple cleaning type which is a combination of a cleaning brush, a cleaning roller, and other members. Alternatively, it is possible to adopt a cleaner less type in which developing device 412 corrects the residual toner after transfer, without providing cleaning device 415.

Intermediate transfer unit 42 includes intermediate transfer belt 421 serving as an intermediate transfer member, primary transfer roller 422, secondary transfer roller 423, drive roller 424, driven roller 425, cleaning device 426 and the like.

Intermediate transfer belt 421 is composed of an endless belt, and installed around drive roller 424 and driven roller 425 in a stretched state. Along with the rotation of drive roller 424 transfer belt 421 runs at a constant speed in the arrow A direction. Intermediate transfer belt 421 is brought into pressure contact with photoconductor drums 413 by primary transfer rollers 422, whereby the toner images of the four colors are primary-transferred to intermediate transfer belt 421 so as to be sequentially superimposed on each other. Then, intermediate transfer belt 421 is brought into pressure contact with recording sheet S by secondary transfer roller 423, whereby the toner image primary-transferred on intermediate transfer belt 421 is secondary-transferred to recording sheet S. It is to be noted that a transfer charger, a transfer roller, and the like may be used as the transferring member in place of the transferring system using intermediate transfer belt 421. A direct transferring system in which toner image is directly transferred from photoconductor drum 413 to recording sheet S may also be adopted.

Belt cleaning device 426 includes a belt cleaning blade that is brought into sliding contact with the surface of intermediate transfer belt 421. Residual toner that remains on the surface of intermediate transfer belt 421 after secondary transfer is scraped and removed by the belt cleaning blade. It is to be noted that cleaning device 426 may be a cleaner of a multiple cleaning type which is a combination of a cleaning brush, a cleaning roller, and other members.

As illustrated in FIG. 1, toner concentration detector 43 is disposed on the downstream side in the rotational direction of intermediate transfer belt 421 relative to a secondary transfer position where toner images are secondary-transferred to recording sheet S, in facing relation to intermediate transfer belt 421.

For example, two toner concentration detectors 43 are disposed so as to face the respective end portions of intermediate transfer belt 421 in the width direction thereof (that is, in the direction orthogonal to the rotational direction of intermediate transfer belt 421, or the horizontal scanning direction). Toner concentration detector 43 is used to generate tone correction data. The process for generating the tone correction data is performed, for example, when a power source switch is turned on, every time when a predetermined number of sheets are printed, when the environmental variation around the apparatus (temperature, humidity, etc.) exceeds a predetermined range, when the apparatus is restarted after troubles such as malfunction are cleared, and when an image stabilization control for stably creating an output image from an input image is being executed. Toner concentration detector 43 detects the concentration of a patch image which is used for the tone correction and formed in a non-image formation region (both end portions of intermediate transfer belt 421 in the width direction) of intermediate transfer belt 421 in such a manner as to face toner concentration detector 43 when intermediate transfer belt 421 rotates. Toner concentration detector 43 outputs a detected concentration to control section 70. The patch image has a size of 20 [mm] (horizontal scanning direction)×18 [mm] (vertical scanning direction), for example.

Toner concentration detector 43 may be a photodetector of a reflection type that includes a light emitting device such as light-emitting diode (LED) and a photodetector such as photodiode (PD), and detects the toner adhesion amount (concentration) of the patch image, for example. A toner adhesion amount of a patch image is represented as $-\log(I/I0)$ wherein I0 is the amount of light incident on the patch image, and I is the amount of light reflected from the patch image. As is obvious from the expression, as the toner adhesion amount of the patch image formed on intermediate transfer belt 421 increases, the amount of light received by the photodetector decreases and accordingly the light reflection amount I decreases, and consequently, the detector output value output from toner concentration detector 43 decreases. Conversely, as the toner adhesion amount of the patch image formed on intermediate transfer belt 421 decreases, the amount of light received by the photodetector increases and accordingly the light reflection amount I increases, and consequently, the detector output value output from toner concentration detector 43 increases.

It is to be noted that the position where toner concentration detector 43 is disposed is not limited to the above-described position. For example, toner concentration detector 43 may be disposed on the upstream side in the rotational direction of intermediate transfer belt 421 relative to the secondary transfer position. It suffices that toner concentration detector 43 is so disposed that toner concentration detector 43 can detect the toner adhesion amount of a patch image formed on intermediate transfer belt 421. In addition, in the case where intermediate transfer belt 421 is made of a light transmissive material, it is possible to adopt as toner concentration detector 43 a photodetector of a transmission type in which a light emitting device and a photodetector are disposed in facing relation with intermediate transfer belt 421 therebetween.

Fixing section 60 is of a belt heating type. Fixing section 60 includes an upper pressing section and a lower pressing section which form a fixing nip portion. Upper pressing section includes a heating roller and a fixing roller. Across the heating roller and the fixing roller, an endless fixing belt is installed with a predetermined belt tensile force. The lower pressing section includes a pressure roller. The pressure roller is brought into pressure contact with the fixing roller with a predetermined fixing load with the fixing belt therebetween. Thus, the fixing nip portion for conveying recording sheet S in a tightly sandwiching manner is formed between the fixing roller and the pressure roller. Fixing section 60 applies heat and pressure to recording sheet S conveyed thereto at the fixing nip portion, thereby fixing a toner image to recording sheet S. It is to be noted that fixing section 60 may be of a roller heating type, or may be a non-contact type fixing member that uses a heat source such as a heating lamp and a heater to heat recording sheet S in a non-contact manner.

Sheet conveying section 50 includes sheet feeding section 51, conveying mechanism 52, and sheet ejection section 53. Three sheet feed tray units 51*a* to 51*c* included in sheet feeding section 51 store sheets S (for example, standard sheets or special sheets) discriminated on the basis of the basis weight, the size, and the like, for each type set in advance.

Sheets S stored in sheet feed tray units 51*a* to 51*c* are send out one by one from the topmost sheet, and are conveyed to image forming section 40 by conveying mechanism 52 having a plurality of conveyance rollers including registration roller 52*a* and the like. At this time, a registration roller section provided with registration rollers 52*a* corrects skew of sheet S fed thereto, and adjusts conveyance timing. Then, image forming section 40 collectively secondary-transfers the toner images on intermediate transfer belt 421 to the surface of recording sheet S, and fixing section 60 performs a fixing process thereon. Recording sheet S on which an image has been formed is ejected out of image forming apparatus 1 by sheet ejection section 53 including ejection rollers 53*a*.

Next, the detailed configuration of developing device 412 will be described.

[Configuration of Developing Device 412]

As illustrated in FIG. 3, developing device 412 includes housing 101 (developer housing section) that houses a developer. Housing 101 is partitioned by wall 102 into stirring chamber 103 and supply chamber 104, and a developer including toner and carrier is housed in housing 101. Stirring screw 105, which is disposed inside stirring chamber 103, conveys the toner and carrier toward the left side in FIG. 3 while stirring the toner and carrier to thereby triboelectrically charge the toner. Supplying screw 106 is disposed inside supply chamber 104, and configured to supply the developer containing the charged toner to developing roller 108 while conveying the developer toward the right side in FIG. 3.

In developing roller 108, a sleeve roller rotates around a fixedly disposed magnet roller, and supplying screw 106 supplies a developer to the outer peripheral surface of the sleeve roller. When the developer supplied to the outer peripheral surface of the sleeve roller moves on the outer peripheral surface of the sleeve roller, the carrier forms a magnetic brush by the magnetic force of magnetic poles provided to the magnet roller. The toner adhered to the magnetic brush adheres to an electrostatic latent image on photoconductor drum 413. Thus, the electrostatic latent image of photoconductor drum 413 is developed by the toner.

The magnet roller has five magnetic poles provided along the rotational direction of the sleeve roller. Among these magnetic poles, main magnetic pole is disposed at a position facing photoconductor drum 413. Same pole sections that generate repulsive magnetic field for separating the developer on the sleeve roller are disposed at respective positions facing the inside of developing device 412. The rotational direction of the sleeve roller is the same as that of photoconductor drum 413 (that is, at a position where the sleeve roller and photoconductor drum 413 face each other, the rotational directions of the sleeve roller and photoconductor drum 413 are opposite to each other).

Supplying screw 106 and stirring screw 105 are spiral screws respectively provided with spiral vanes 110 and 112. Each of spiral vanes 110 and 112 has a predetermined spiral pitch and is provided over the substantially entire region of the shaft (rotational axis). Developing roller 108, supplying screw 106, and stirring screw 105 are disposed in such a manner that developing roller 108, the rotational axes of supplying screw 106, and stirring screw 105 are in parallel to each other.

On both end sides of partition wall 102, communication ports 114 and 116 for exchanging the developer between stirring chamber 103 and supply chamber 104 are provided, thus forming a circulation path in which the developer housed in housing 101 circulates between stirring chamber 103 and supply chamber 104 through communication ports 114 and 116 while being stirred by stirring screw 105 and supplying screw 106. It is to be noted that the circulation path formed inside housing 101 may be a vertical circulation path, or a three-axis circulation path.

Carrier replenishment port 118 is provided on the upstream side of stirring chamber 103 in the developer conveyance direction. At carrier replenishment port 118 (carrier replenishment position), supply of carrier is received through carrier hopper 120 (carrier replenishing section) filled with carrier.

At a portion near carrier replenishment port 118, carrier concentration detector 140 (carrier concentration detecting section) that detects the carrier concentration (the ratio of the carrier in the developer) in housing 101 is provided. The carrier concentration detector 140, which is also called TCR detector, outputs a detected carrier concentration to control section 70. For example, carrier concentration detector 140 outputs a detector signal containing a count value which is in substantially inverse proportion to the value of the carrier concentration. Control section 70 can determine the value of the carrier concentration on the basis of the count value contained in the detector signal output from carrier concentration detector 140.

The portion near carrier replenishment port 118 corresponds to a range of the position of carrier concentration detector 140 within which change in carrier concentration can be detected before the carrier is completely mixed with the developer in housing 101 when carrier is supplied through carrier hopper 120. In the present embodiment, carrier concentration detector 140 is disposed on the bottom surface of stirring chamber 103 and on the downstream side of carrier replenishment port 118 in the developer conveyance direction of stirring chamber 103.

Carrier concentration detector 140 is a magnetic detector that measures change in magnetic permeability of the developer by utilizing the fact that carrier is a paramagnetic substance to detect the carrier concentration on the basis of the amount of carrier in a unit volume. Carrier concentration detector 140 detects change in inductance of two coils caused by change in magnetic permeability as the carrier concentration. It is to be noted that carrier concentration detector 140 is not limited to magnetic detectors, and reflection type photodetectors may be adopted as carrier concentration detector 140, similarly to toner concentration detector 43.

Toner replenishment port 122 is provided on the upstream side of carrier replenishment port 118 in the developer conveyance direction of stirring chamber 103. At toner replenishment port 122, supply of toner is received through toner hopper 124 filled with toner.

It is also possible to adopt a configuration in which carrier hopper 120 is filled with toner together with carrier and the toner and carrier are separately supplied. In addition, carrier hopper 120 may supply carrier to developing device 412 of each of image forming units 41Y, 41M, 41C and 41K. In addition, it is also possible to adopt a configuration in which toner hopper 124 is filled with carrier together with toner and the toner and carrier are separately supplied.

The shaft of supplying screw 106 extends toward the downstream side in the developer conveyance direction beyond communication port 116, and the end portion of the shaft on the downstream side in the developer conveyance direction is located in developer ejection section 126 protruding toward the downstream side in the developer conveyance direction of supply chamber 104.

The shaft of supplying screw 106 is provided with, on its downstream side in the developer conveyance direction, reverse spiral vane 128 whose spiral direction is opposite to that of spiral vane 110. Reverse spiral vane 128 has a spiral pitch smaller than that of spiral vane 110. Reverse spiral vane 128 controls conveyance of the developer in the developer conveyance direction of supplying screw 106 so as to forward the developer to communication port 116.

The shaft of supplying screw 106 located in developer ejection section 126 is provided with spiral vane 130 whose spiral direction is the same as that of spiral vane 110. Spiral vane 130 has a spiral pitch smaller than that of spiral vane 110.

Developer discharge port 132 for discharging the developer is provided on the bottom surface of developer ejection section 126. Spiral vane 130 forwards the developer which has passed through reverse spiral vane 128 to developer discharge port 132. Developer correction container 134 is mounted to developer discharge port 132. As in the present embodiment, developer discharge port 132 is desirably provided at a position where the supplied carrier is sufficiently mixed with the developer in housing 101 (the most downstream position in the developer conveyance direction) so that the supplied toner is not discharged instantly.

Reverse spiral vane 128 and spiral vane 130 of supplying screw 106 and developer ejection section 126 form a trickle discharging mechanism for discharging excess developer from developer discharge port 132 when the amount of the developer in housing 101 is excessively increased. It is to be noted that the developer discharging mechanism may have a configuration in which the height of housing 101 is so set that only developer discharge port 132 is low for the purpose of discharging excess developer in housing 101 from developer discharge port 132.

Figure 4:
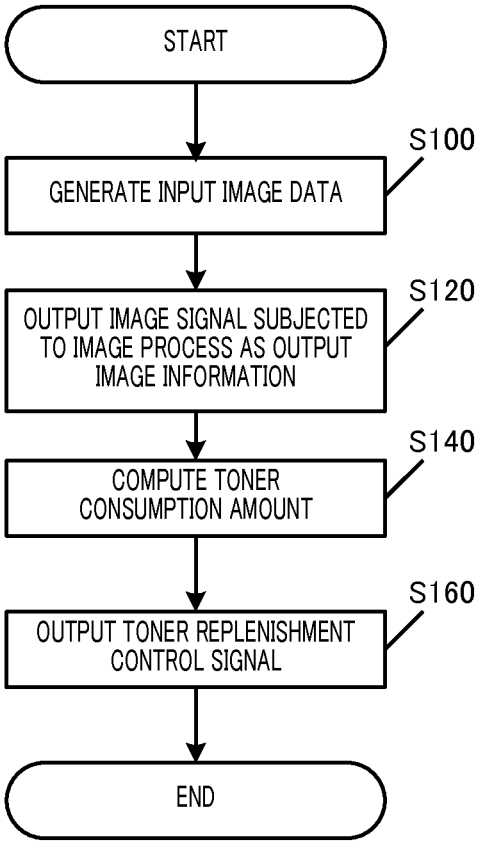
FIG. 4 is a flowchart illustrating a toner replenishment control operation according to the present embodiment.

Next, a toner replenishment control operation will be described with reference to the flowchart of FIG. 4.

[Toner Replenishment Control Operation]

First, image reading section 10 generates input image data on the basis of a result of reading by document image scanning device 12 (step S100). Next, image processing section 30 performs various digital image processing on the input image data generated by image reading section 10, and outputs an image signal subjected to the image processing as output image information (step S120).

Next, control section 70 computes an toner consumption amount required for an image forming process performed by image forming section 40 on the basis of output image information output from image processing section 30 (step S140). Finally, in accordance with the toner consumption amount thus computed, control section 70 outputs, to toner hopper 124, a toner replenishment control signal requesting supply of toner (step S160). As a result, toner is supplied from toner hopper 124 to toner replenishment port 122. Upon completion of the process of step S160, the toner replenishment control operation is terminated. It is to be noted that, in the present embodiment, control section 70 computes the consumption amount of the color toners of the Y-component, M-component, C-component and K-component on the basis of the output image information, and controls developing device 412 to supply toner corresponding to the consumption amount thus computed.

Figure 5:
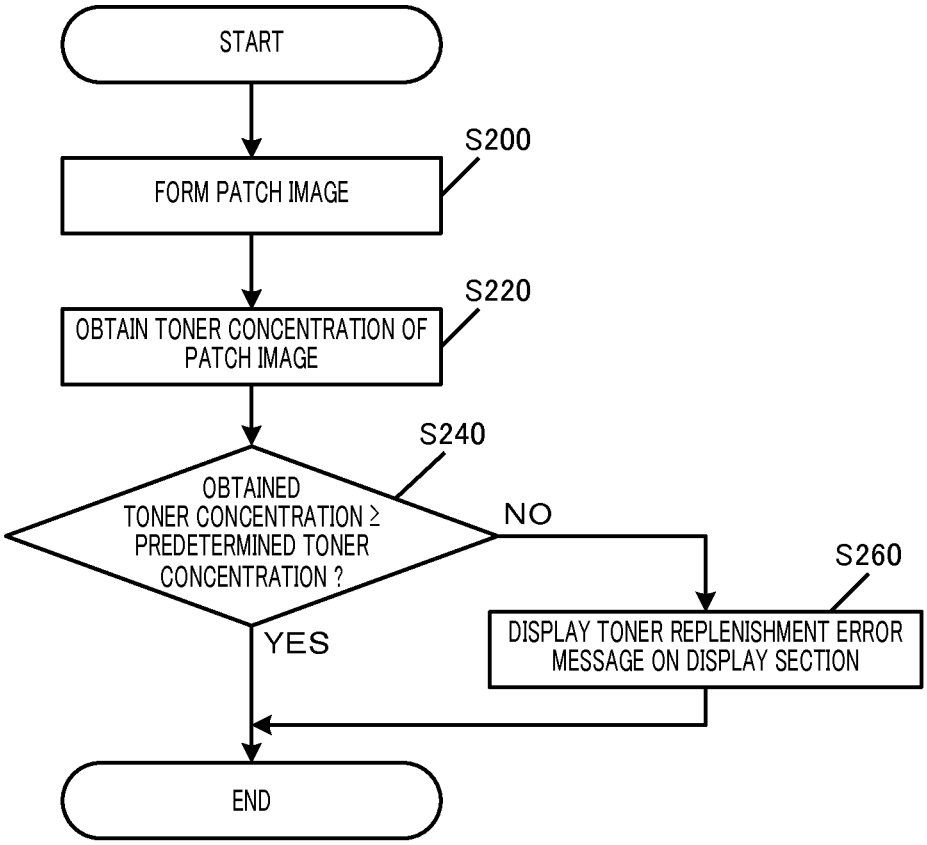
FIG. 5 is a flowchart illustrating the operation for checking toner replenishment according to the present embodiment.

Next, an operation for checking toner replenishment will be described with reference to the flowchart of FIG. 5. The checking operation is executed after the replenishment operation is performed.

[Operation for Checking Toner Replenishment]

In the following, an example will be described in which image forming section 40 is controlled to form a patch image of the toner of the K-component on intermediate transfer belt 421.

First, control section 70 controls image forming section 40 to form a patch image of the toner of the K-component on intermediate transfer belt 421 (step S200). Next, control section 70 indirectly obtains the toner concentration of the patch image on intermediate transfer belt 421 which is detected by toner concentration detector 43, as the toner concentration in housing 101 (step S220). The toner concentration thus obtained is temporarily stored in RAM 73. After passing through a detecting region of toner concentration detector 43, the patch image formed on intermediate transfer belt 421 is removed by belt cleaning device 426.

Next, control section 70 determines whether the toner concentration of the patch image obtained at step S220 is not lower than a predetermined toner concentration (acceptable lower limit of toner concentration) (step S240). When it is determined that the toner concentration is not lower than the predetermined toner concentration (YES at step S240), control section 70 determines that the toner replenishment operation has been properly performed. Then, the operation for checking the toner replenishment is terminated.

On the other hand, when it is determined that the toner concentration is lower than the predetermined toner concentration (NO at step S240), control section 70 determines that the toner replenishment operation has not been properly performed, and controls display section 21 to display messages (toner replenishment error) indicating necessity for measures such as reconditioning of the toner replenishment mechanism, and replacement of a toner bottle (not illustrated) which is provided above toner hopper 124 and configured to supply toner to toner hopper 124 (step S260). Upon completion of the process of step S260, the operation for checking the toner replenishment is terminated. It is to be noted that control section 70 may output audio information indicating the toner replenishment error from a speaker (not illustrated).

Figure 6:
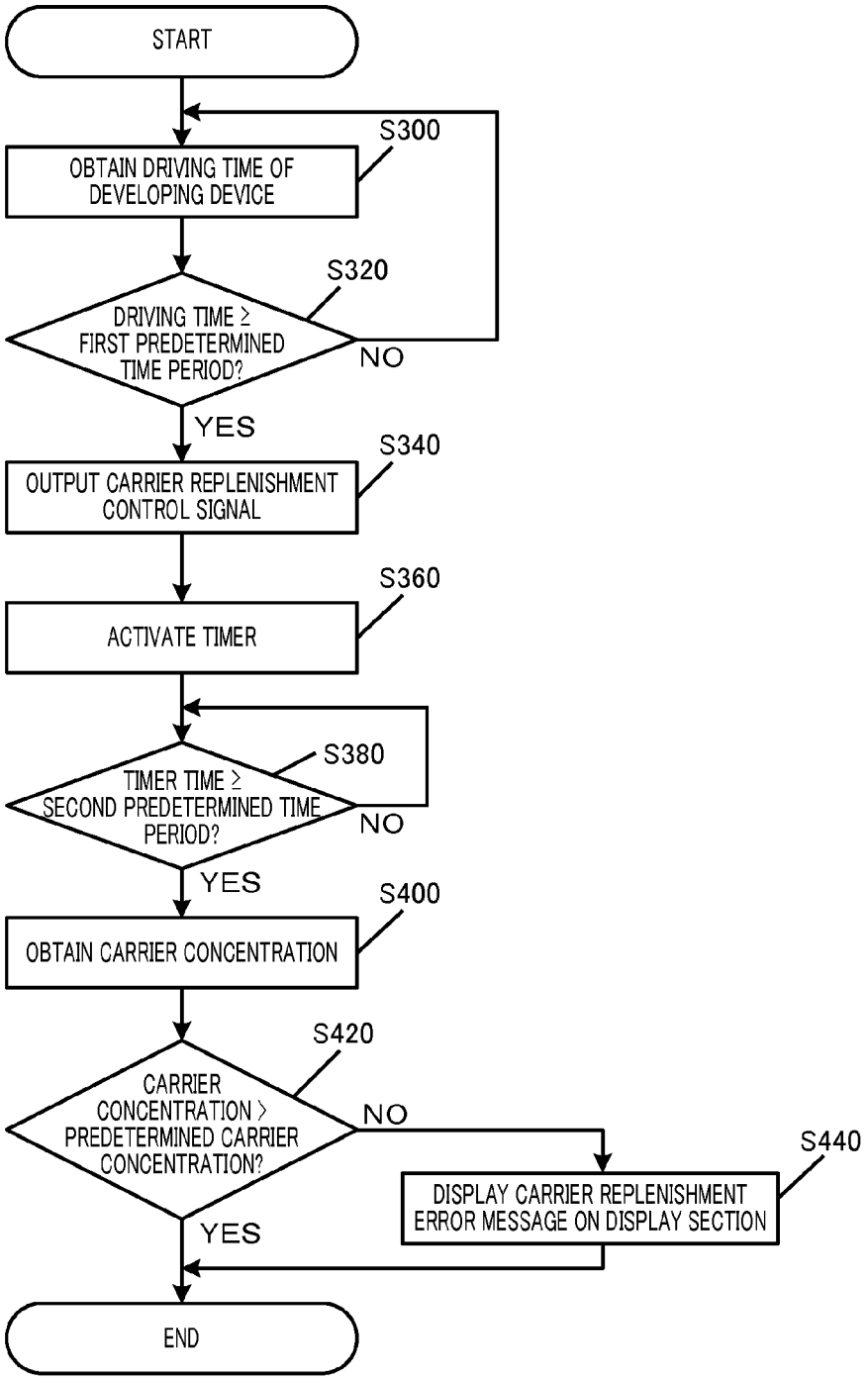
FIG. 6 is a flowchart illustrating a carrier replenishment control operation according to the present embodiment.

Next, a carrier replenishment control operation will be described with reference to the flowchart of FIG. 6.

[Carrier Replenishment Control Operation]

In the following, an example will be described in which carrier is supplied in an replenishment amount corresponding to the driving time of developing device 412, but it is also possible to supply carrier in an replenishment amount corresponding to the number of printed sheets.

First, control section 70 obtains the driving time of developing device 412 (step S300). Next, control section 70 determines whether the obtained driving time is not shorter than a first predetermined time period (for example, 10 [min]) (step S320). When it is determined that the driving time is shorter than the first predetermined time period (NO at step S320), the process is returned to step S300.

On the other hand, when it is determined that the driving time is not shorter than the first predetermined time period (YES at step S320), control section 70 outputs a carrier replenishment control signal requesting supply of carrier in accordance with the obtained driving time to carrier hopper 120 (step S340). As a result, a carrier replenishment operation from carrier hopper 120 to carrier replenishment port 118 is started.

Next, control section 70 activates a timer not illustrated (step S360). Next, whether a time measured by the timer activated by control section 70 (hereinafter referred to as timer time) is not shorter than a second predetermined time period (for example, two [seconds]) is determined (step S380). When it is determined that the timer time is shorter than the second predetermined time period (NO at step S380), the process is returned to step S380.

On the other hand, when it is determined that the timer time is not shorter than the second predetermined time period (YES at step S380), control section 70 obtains the carrier concentration detected by carrier concentration detector 140 during the second predetermined time period (step S400). It is to be noted that control section 70 deactivates the timer. Next, control section 70 determines whether the carrier concentration obtained at step S400 is higher than a predetermined carrier concentration (step S420). When it is determined that the carrier concentration is higher than the predetermined carrier concentration (YES at step S420), control section 70 determines that the carrier replenishment operation has been properly performed. Then, the carrier replenishment control operation is terminated.

On the other hand, when it is determined that the carrier concentration is not higher than the predetermined carrier concentration (NO at step S420), control section 70 determines that the carrier replenishment operation has not been properly performed, and controls display section 21 to display messages (carrier replenishment error) indicating necessity for measures such as reconditioning of the carrier replenishment mechanism, and replacement of a carrier bottle (not illustrated) which is provided above carrier hopper 120 and configured to supply carrier to carrier hopper 120 (step S440). Upon completion of the process of step S440, the operation for checking the carrier replenishment is terminated. It is to be noted that control section 70 may output audio information indicating the carrier replenishment error from a speaker (not illustrated).

Figure 7:
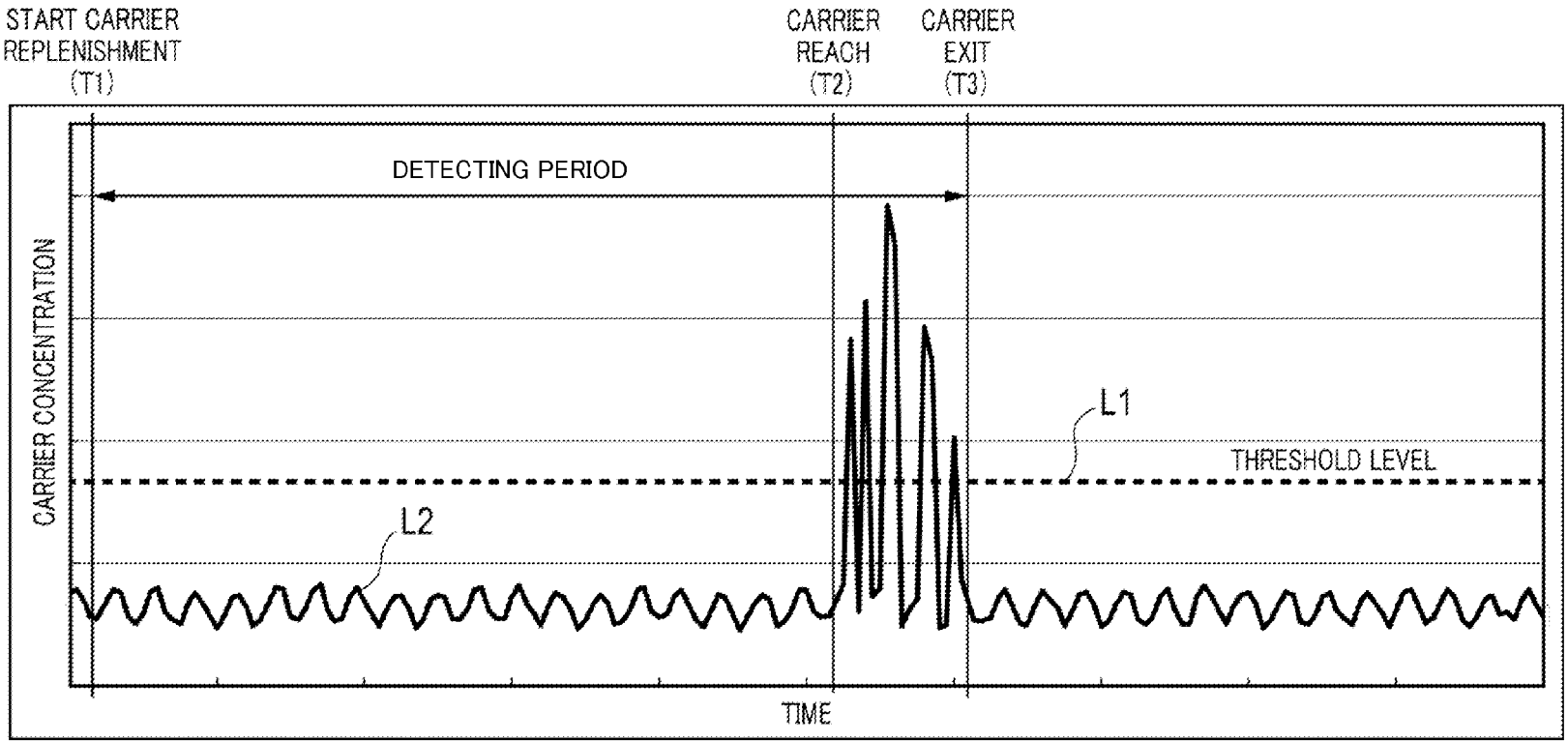
FIG. 7 illustrates a change of a carrier concentration detected by a carrier concentration detector according to the present embodiment.

FIG. 7 illustrates a varying state of the carrier concentration detected by carrier concentration detector 140 in a carrier replenishment control operation. In FIG. 7, the abscissa represents time, and the ordinate represents the carrier concentration. Here, an exemplary case is described in which a replenishment control operation for supplying 1 [g] carrier is performed in a state where housing 101 of developing device 412 is filled with 800 [g] developer. Time T1 is a time at which a carrier replenishment control signal is output to carrier hopper 120, and a replenishment operation for supplying carrier to carrier replenishment port 118 is started. Time T2 is a time at which the supplied carrier reaches the detecting region of carrier concentration detector 140, and starts to pass through the detecting region. Time T3 is a time at which the supplied carrier exits the detecting region of carrier concentration detector 140. The period from time T1 to time T3 corresponds to the second predetermined time period described in the flowchart of FIG. 6. Times T2 and T3 can be acquired by a simulation on the basis of conditions such as the structure of developing device 412 and the position of carrier concentration detector 140.

In the present embodiment, control section 70 obtains the carrier concentration (represented by curve L2) detected by carrier concentration detector 140 in the period from time T1 to time T3. Then, when the carrier concentration detected in the period from time T2 to time T3 is not lower than a threshold level (predetermined carrier concentration) represented by dotted line L1 as illustrated in FIG. 7, control section 70 determines that the carrier replenishment operation has been properly performed.

Figure 8:
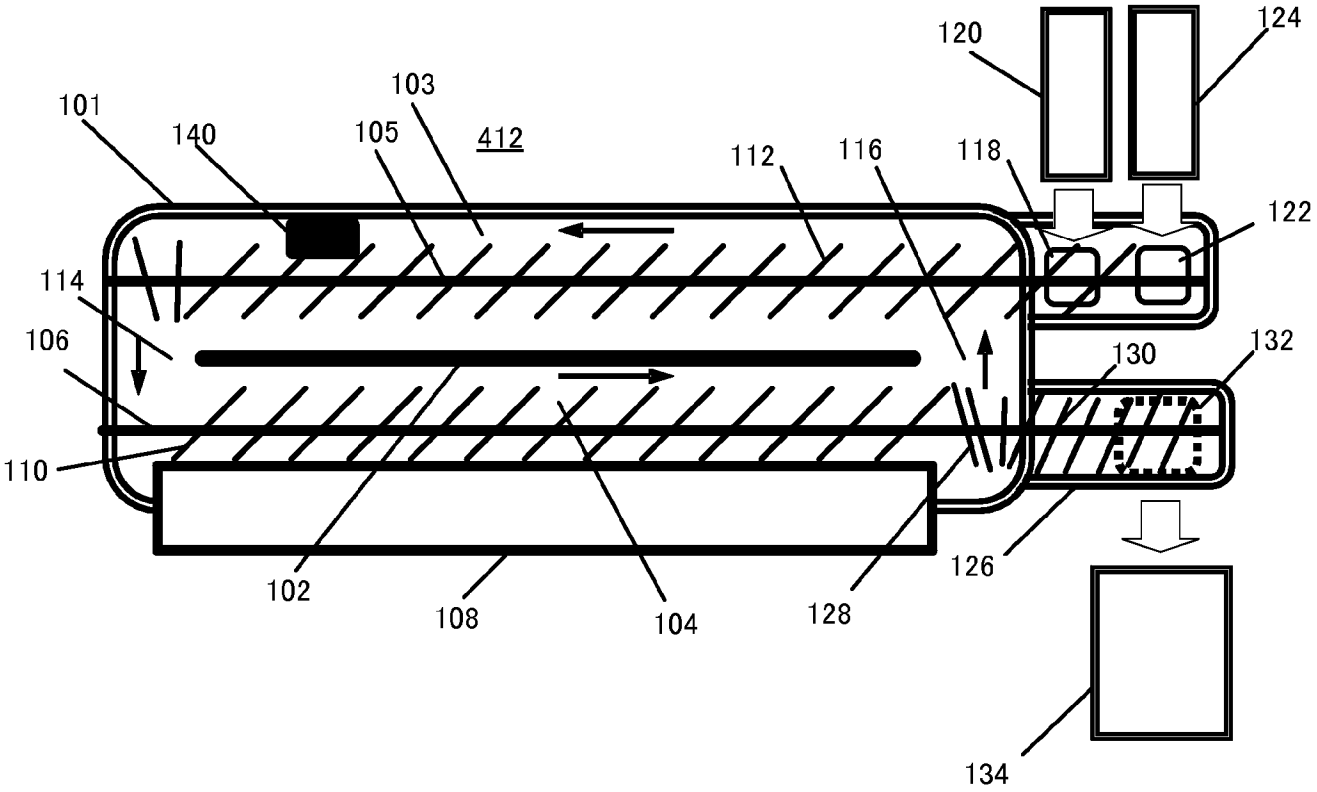
FIG. 8 illustrates a configuration of a developing device according to a comparative configuration of the present embodiment.

FIG. 8 illustrates a configuration of developing device 412 in the case where carrier concentration detector 140 is provided at a position distanced from carrier replenishment port 118. In this configuration, carrier replenishment port 118 is provided at a position near toner replenishment port 122 on the downstream side in the developer conveyance direction of stirring chamber 103.

Figure 9:
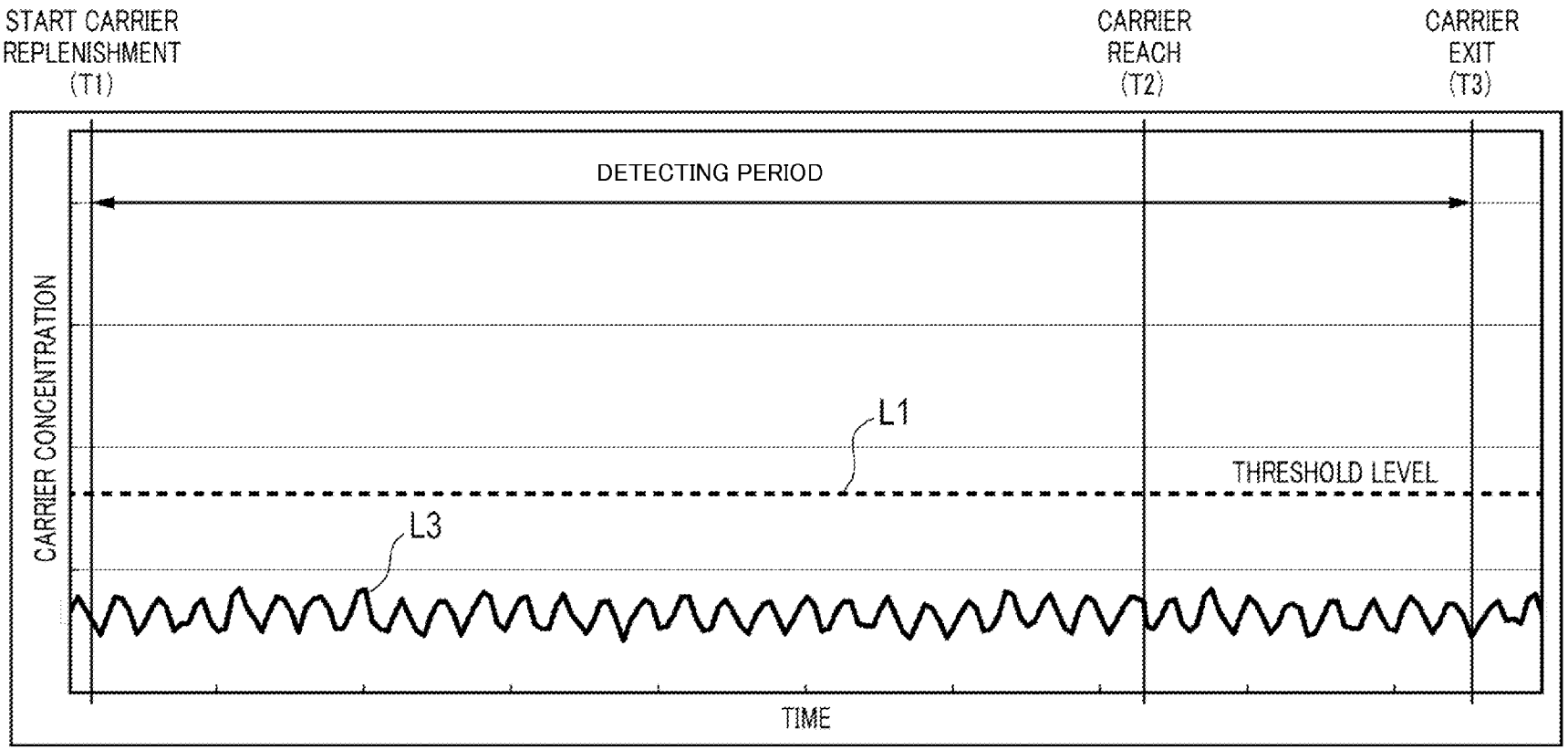
FIG. 9 illustrates a change of a carrier concentration detected by a carrier concentration detector according to the comparative configuration of the present embodiment.

FIG. 9 illustrates a varying state of the carrier concentration detected by carrier concentration detector 140 when a carrier replenishment control operation is performed in developing device 412 of FIG. 8. In FIG. 9, the abscissa represents time, and the ordinate represents the carrier concentration. Here, an exemplary case is described in which a replenishment control operation for supplying 1 [g] carrier is performed in a state where housing 101 of developing device 412 is filled with 800 [g] developer.

Time T1 is a time at which a carrier replenishment control signal is output to carrier hopper 120, and a replenishment operation for supplying carrier to carrier replenishment port 118 is started. Time T2 is a time at which the supplied carrier reaches the detecting region of carrier concentration detector 140, and starts to pass through the detecting region. Since the distance between carrier replenishment port 118 and carrier concentration detector 140 in developing device 412 of FIG. 8 is greater than that of developing device 412 of FIG. 3, the period from time T1 to time T2 is extended. Time T3 is a time at which the supplied carrier exits the detecting region of carrier concentration detector 140. The period from time T1 to time T3 corresponds to the second predetermined time period described in the flowchart of FIG. 6. Times T2 and T3 can be acquired by a simulation on the basis of conditions such as the structure of developing device 412 and the position of carrier concentration detector 140.

Control section 70 obtains the carrier concentration (represented by curve L3) detected by carrier concentration detector 140 in the period from time T1 to time T3. Then, when the carrier concentration detected in the period from time T2 to time T3 is lower than a threshold level represented by dotted line L1 (predetermined carrier concentration) as illustrated in FIG. 9, control section 70 determines that the carrier replenishment operation has not been properly performed. As described, when the distance between carrier replenishment port 118 and carrier concentration detector 140 is great, carrier concentration detector 140 cannot detect the supplied carrier as a change in the carrier concentration. Since the replenishment amount of carrier is as small as 1.0 [g], the amount of increase in carrier concentration after the carrier is sufficiently mixed with the developer housed in housing 101 is estimated to be about 0.1[%]. The about 0.1 [%] increase is not sufficient to determine whether the carrier replenishment operation has been properly performed by using carrier concentration detector 140.

Effect of the Present Embodiment

As has been described in detail, the developing device according to the present embodiment includes: housing 101 configured to house a developer including toner and carrier; carrier hopper 120 configured to supply the carrier to housing 101; carrier concentration detector 140 provided at a position near carrier replenishment port 118 at which the carrier is received from carrier hopper 120 in housing 101, carrier concentration detector 140 being configured to detect a carrier concentration in housing 101; and control section 70 configured to determine whether the carrier is properly supplied to housing 101 on the basis of a result of detecting by carrier concentration detector 140. To be more specific, control section 70 determines that the carrier has been properly supplied to housing 101 when the carrier concentration detected by carrier concentration detector 140 is not lower than a predetermined concentration, and determines that the carrier has not been properly supplied to housing 101 when the carrier concentration detected by carrier concentration detector 140 is lower than a predetermined concentration.

Carrier is very easily mixed with a developer as compared with toner. In particular, carrier is instantly mixed with a developer when a small amount of carrier is supplied. According to the embodiment, however, change in the carrier concentration can be detected before carrier is completely mixed with a developer at the time of the carrier replenishment control operation, and therefore whether supply of carrier has been properly performed can be accurately determined. Consequently, when supply of carrier has not been properly performed, it is possible to notify the user of such a fact so as to take measures such as reconditioning of the carrier replenishment mechanism, and replacement of a carrier bottle. As a result, a situation where the replacement of degraded carrier with newly supplied carrier is not performed for a long period can be prevented, and favorable toner charging performance can be maintained for a long period, whereby favorable images without fogging, toner scattering, and the like can be formed. In the above-mentioned manner, it is possible to prevent a defect which is caused when supply of carrier is not properly performed in the case where toner and carrier are separately supplied.

MODIFICATION

While in the above-mentioned embodiment an example is described in which whether carrier has been properly supplied to housing 101 is determined on the basis of a result detected by one carrier concentration detector 140, the present invention is not limited thereto. For example, whether carrier has been properly supplied to housing 101 can be determined on the basis of results detected by two carrier concentration detectors 140. In this case, two carrier concentration detectors 140 are respectively provided at a position near carrier replenishment port 118 and a position distanced from carrier replenishment port 118. Control section 70 determines that carrier has been properly supplied to housing 101 when the difference between the carrier concentrations detected by two carrier concentration detectors 140 is not lower than a predetermined concentration, and determines that carrier has not been properly supplied to housing 101 when the difference between the carrier concentrations detected by two carrier concentration detectors 140 is lower than the predetermined concentration.

In addition, in the above-mentioned embodiment, carrier concentration detector 140 may function as a member that directly detects the toner concentration in housing 101. With this configuration, provision of toner concentration detector 43, and forming of a patch image on intermediate transfer belt 421 are not required, and the toner concentration in housing 101 can be accurately detected. In this case, desirably, a toner concentration in a steady state, which is established after toner supplied from toner hopper 124 is sufficiently stirred and mixed with the developer in housing 101, can be detected, and carrier concentration detector 140 is distanced from toner replenishment port 122 as much as possible. For example, desirably, carrier concentration detector 140 is provided at a position on the upstream side of toner replenishment port 122 in the developer conveyance direction, or a position separated from toner replenishment port 122 by a predetermined distance on the downstream side of toner replenishment port 122 in the developer conveyance direction.

Incidentally, in the case where the toner replenishment control operation is performed on the basis of the toner concentration detected by carrier concentration detector 140 (that is, in the case where toner is supplied when the toner concentration is lower than a predetermined value), when the change in the carrier concentration (that is, the change in the toner concentration) as illustrated in FIG. 7 is detected at the time of supply of carrier, control section 70 may determine that the toner concentration in housing 101 is decreased, and may excessively supply toner. Therefore, desirably, the toner replenishment control operation using the toner concentration detected by carrier concentration detector 140 is not performed in a third predetermined time period (for example, 0.4 [seconds]) from a time when carrier supplied from carrier hopper 120 reaches and starts to pass through the detecting region of carrier concentration detector 140 until the carrier exits the detecting region. In other words, it is desirable to determine whether carrier has been properly supplied to housing 101 by using the carrier concentration detected by carrier concentration detector 140 only in the third predetermined time period.

It should be understood by those skilled in the art that various modifications, combinations, sub-combinations and alterations may occur depending on design requirements and other factors in so far as they are within the scope of the appended claims or the equivalents thereof.

What is claimed is:

1. A developing device comprising:

a developer housing section structured to house a developer including toner and carrier;

a carrier replenishing section structured to supply the carrier to the developer housing section;

a carrier concentration detecting section provided at a position near a carrier replenishment position at which the carrier is received from the carrier replenishing section in the developer housing section, the carrier concentration detecting section being structured to detect a carrier concentration of the developer in the developer housing section after the carrier is supplied; and a carrier replenishment determination section structured to determine whether the carrier is properly supplied to the developer housing section on the basis of a result of detecting by the carrier concentration detecting section.

2. The developing device according to claim 1, wherein the carrier concentration detecting section is structured to measure a magnetic permeability of the developer in the developer housing section to detect the carrier concentration.

3. The developing device according to claim 1, wherein the carrier replenishment determination section is structured to determine that the carrier is properly supplied to the developer housing section when a carrier concentration detected by the carrier concentration detecting section is not lower than a predetermined concentration, and determine that the carrier is not properly supplied to the developer housing section when the carrier concentration detected by the carrier concentration detecting section is lower than the predetermined concentration.

4. The developing device according to claim 1, wherein the carrier replenishment determination section is structured to determine whether the carrier is properly supplied to the developer housing section on the basis of a result of detecting by the carrier concentration detecting section in a period from a start of supply of the carrier by the carrier replenishing section until the carrier exits a detecting region of the carrier concentration detecting section.

5. The developing device according to claim 1, wherein the carrier replenishment determination section is structured to determine whether the carrier is properly supplied to the developer housing section on the basis of a result of detecting by the carrier concentration detecting section in a period from a time when the carrier starts to pass through a detecting region of the carrier concentration detecting section until the carrier exits the detecting region, after supply of the carrier by the carrier replenishing section is started.

6. The developing device according to claim 1 further comprising a notification section configured to indicate a result of determination by the carrier replenishment determination section when the carrier replenishment determination section is structured to determine that the carrier is not properly supplied to the developer housing section.

7. An image forming apparatus comprising the developing device according to claim 1.

* * * * *